US007641286B2

(12) United States Patent
Siepenkort et al.

(10) Patent No.: US 7,641,286 B2
(45) Date of Patent: Jan. 5, 2010

(54) PLOUGH GUIDE FOR A CHAIN-PULLED PLOUGH

(75) Inventors: Gerhard Siepenkort, Lunen (DE); Adam Klabisch, Dortmund (DE); Norbert Hesse, Bochum (DE); Klaus Duhnke, Bochum (DE); Andre Göller, Werne (DE)

(73) Assignee: DBT GmbH, Lunen (DE)

( * ) Notice: Subject to any disclaimer, the term of this patent is extended or adjusted under 35 U.S.C. 154(b) by 16 days.

(21) Appl. No.: 11/375,865

(22) Filed: Mar. 15, 2006

(65) Prior Publication Data

US 2006/0244302 A1 Nov. 2, 2006

(30) Foreign Application Priority Data

Mar. 16, 2005 (DE) ..... 20 2005 004 383 U

(51) Int. Cl.
*E21C 27/34* (2006.01)
*E21C 35/08* (2006.01)

(52) U.S. Cl. ..... 299/34.1

(58) Field of Classification Search ..... 299/34.1, 299/43

See application file for complete search history.

(56) References Cited

U.S. PATENT DOCUMENTS

| | | | | |
|---|---|---|---|---|
| 3,285,663 | A * | 11/1966 | Hauschopp | 299/34.11 |
| 4,561,697 | A * | 12/1985 | Hauschopp | 299/43 |
| 7,314,253 | B2 * | 1/2008 | Tillessen et al. | 299/34.1 |
| 2004/0256907 | A1 * | 12/2004 | Merten et al. | 299/34.04 |
| 2005/0161995 | A1 * | 7/2005 | Tillessen et al. | 299/34.1 |

* cited by examiner

*Primary Examiner*—Sunil Singh
(74) *Attorney, Agent, or Firm*—Cook Alex Ltd.

(57) ABSTRACT

A plough guide trough for plough guides of chain-drawn coal ploughs, comprising two superposed chain guide ducts separated by an integrally cast sliding spacer member, with a top guide strip, a bottom guide beam and a bottom slideway for guiding the plough. The top chain guide duct is covered by a front wall comprising the guide strip and merging into the guide beam and a slot lead-through for a plough guiding hook or plough knife is formed between the guide beam and the slideway. Pockets in the front wall receive a toggle coupling for neighboring plough guide troughs, wherein the front wall, the guide strips, the guide beam, the pockets and a back wall comprising the slideway form a one-piece casting extending over the length of the plough guide trough.

9 Claims, 3 Drawing Sheets

PLOUGH GUIDE FOR A CHAIN-PULLED PLOUGH

The present invention relates to a plough guide trough for plough guides of chain-drawn coal ploughs, especially chain-pulled ploughs comprising two superposed chain guide ducts separated by an integrally cast sliding spacer member, with a top guide strip, a bottom guide beam and a bottom slideway for guiding the plough, wherein the top chain guide duct is covered by a front wall comprising the guide strip and merging into the guide beam and a slot lead-through for a plough guiding hook or plough knife is formed between the guide beam and the slideway, also comprising pockets in the front wall for receiving toggle coupling means for neighbouring plough guide troughs.

Previously proposed plough guide troughs are used especially in underground mining, in the case of coal ploughs. In such cases the plough guide troughs are mounted on the working-face side on conveyor pans of a scraper chain conveyor, for removing coal ploughed off the longwall face by the plough. The length of the plough guide troughs is equal to the length of a conveyor pan, and the scraper chain conveyor or plough guide is formed by joining numerous substantially similar plough guide troughs or conveyor pans by tension-resistant bendable coupling means in the form of toggles. In modern heavy-duty plough systems the plough is mechanically guided on the top guide strip and the bottom guide beam and the plough body also rests on the slideway, which for this purpose projects over the guide beam.

Glückauf 140, No. 11, from page 510 describes initial practical experience with a guide for chain-drawn ploughs developed by the current Assignees and published in DE 203 07 150 U1. The known plough guide comprises a combined cast and welded construction, the plough guide being divided into a middle part and two end parts, each of which are separate castings formed of highly wear-resistant casting material with a high chromium and manganese content and subsequently welded together to form a plough guide trough. A suitably highly wear-resistant casting material of this construction increases the wear resistance by a factor of about 1.8 compared with the plough guide troughs previously in use. However, the known three-part construction is comparatively complicated to produce and separate casting moulds are relatively expensive.

An aim of the present invention is to construct a plough guide trough which has substantially the same resistance to wear as the known plough guide trough but has advantages regarding production.

Accordingly, the present invention is directed to a plough guide trough as described in the opening paragraph of the present specification, wherein the front wall, the guide strips, the guide beam, the pockets and a back wall comprising the slideway form a one-piece casting extending over the length of the plough guide trough. Owing to the integral construction of the front wall with the guide strip and guide beam and the integrally cast pockets, there is no need for the three-part construction hitherto chosen in the prior art. This also obviates the welding steps which were essential in the prior art in order to joint the two end parts to the middle part. Since furthermore both the guide strip and the guide beam are constructed without welds, there are no transitional edges or the like in a plough guide trough, so that the risk of wear is further reduced. The complete plough guide trough with all its functional regions is therefore formed from a single casting.

In a preferred embodiment the back wall on its outside is provided with at least one or preferably exactly two integrally cast locking pockets for engagement of locking lugs or locking tongues on an interchangeable top trough of a conveyor pan trough. The locking pockets integrally moulded on the back of the plough guide trough can then form vertical locking means for the interchangeable trough insertable into a conveyor pan trough.

Advantageously, the guide strips and/or the guide beam are provided with reworked peripheral guide surfaces. This can be done for example by providing a slight excess of material on the casting before machining and subsequently removing it, for example mechanically, in order to improve the guide surfaces. The reworking can alternatively or additionally be in the form of surface hardening or the like.

Preferably also the guide strip and/or guide beam have vertical peripheral guide surfaces or surfaces approximately at right angles to one another or guide surfaces which are substantially vertical in use. In this way the guide strips and/or guide beam can be given a substantially rectangular rail-like cross-section.

Advantageously also, in the case of a cast construction, the underside of the slideway is formed with at least one and preferably a number of weight-reducing recesses, wherein a supporting rib is advantageously formed on both sides of each recess. Two or three ribs were usually sufficient to support the plough guide trough on the floor.

A plough guide trough in accordance with the present invention can be given a continuous front wall between two pockets or receivers.

Preferably however, in the case of plough guides, at least one plough guide trough is formed with inspection openings or inspection openings.

In a preferred embodiment, therefore, the front wall has an integrally cast inspection opening which is closable or closed by a lid.

In an advantageous embodiment, near the inspection opening the sliding spacer member has an integrally moulded recess, into which an interchangeable grating is insertable or inserted. The grating, which has passages and forms part of the bottom of the top chain guide ducts when installed, allows fine coal entering the top chain guide ducts to fall through, so that a plough chain in the top chain duct cannot be blocked by excessive accumulations of fine coal.

Preferably a stable and also easily dismountable fastening for the closure lid can be obtained if bores for fastening a closure lid are formed on the transition from the guide strip to the top chain guide duct, the bore axes slope down from the back of the guide strip to the top boundary edge of the inspection opening. Owing to the slope of the bore axes and consequently of the fastening screws, the spacing of the guide strip is increased between the screw heads and the guide region on the working-face side, so that the guide surface on the guide strip is not interrupted by recesses for engaging screw heads and/or screwed nuts.

Advantageously also the closure lid can have a sight or inspection opening, preferably suitably shaped for receiving a load hook or a load lug.

Examples of plough guide troughs made in accordance with the present invention will now be explained with reference to the accompanying drawings, in which.

Figure 1:
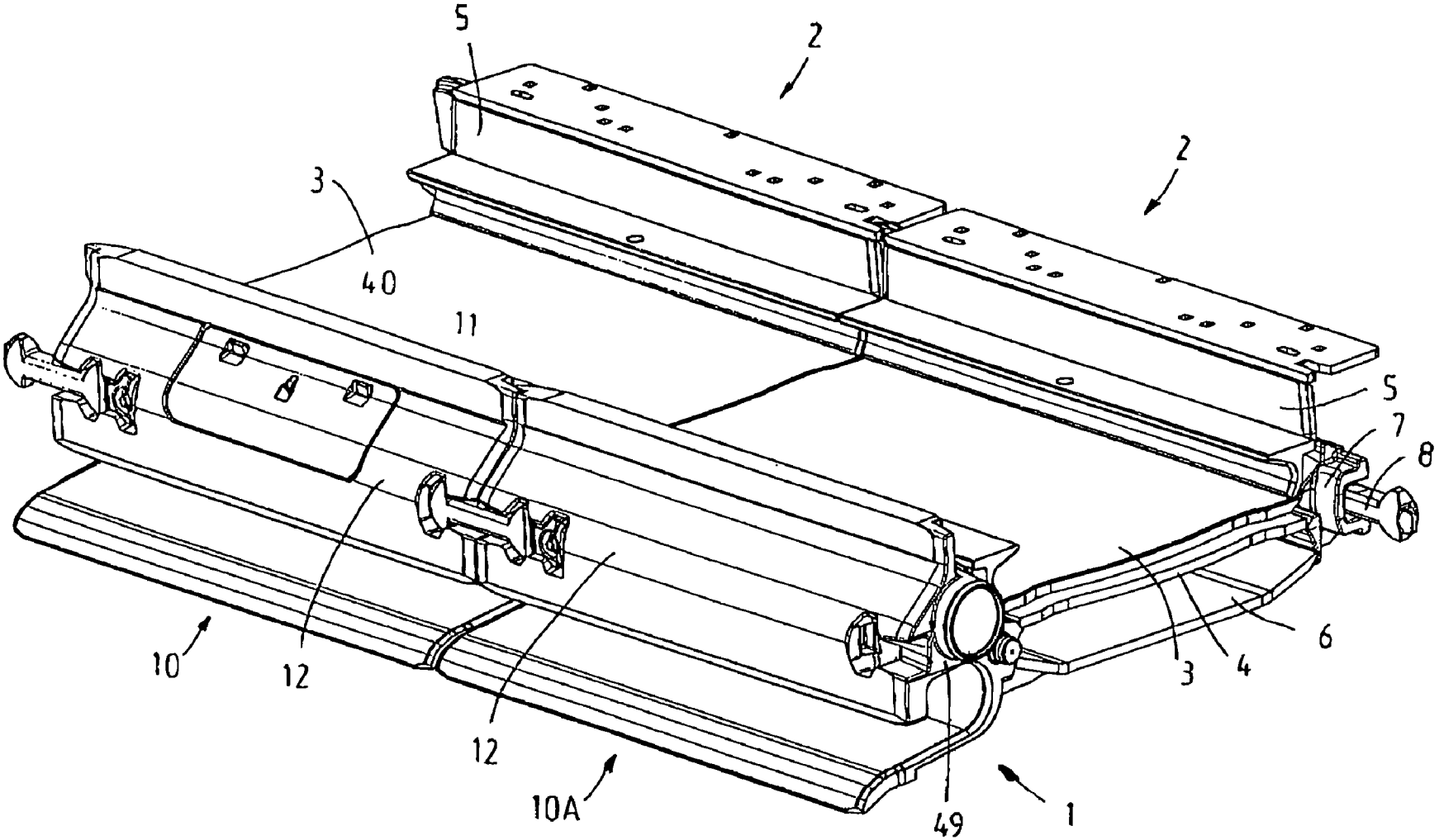
FIG. 1 shows a perspective view of two conveyor pans on a scraper chain conveyor with integrally mounted plough guide troughs.

FIG. 1 is a partial view of a plough guide 1 for a coal plough mounted in known manner on the conveyor pans 2 of a scraper chain conveyor on the working-face side. The line of pans in the scraper chain conveyor is formed of individual conveyor pans 2, connected to one another in tension-resistant manner with limited ability to bend, and the plough guide 1 is formed of individual plough guide troughs 10, 10A which in the example embodiment shown each form the side cheek of the conveyor pans 2 of the scraper chain conveyor on the working-face side and are substantially equal in length to the conveyor pans 2 of the scraper chain conveyor. In the example embodiment shown, the conveyor pans 2 of the scraper chain conveyor each have a top run in the form of an interchangeable trough 3 which rests on an intermediate base 4 welded to a side cheek 5 facing the filled-up workings and to the back of the plough guide trough 10, 10A on the working-face side. The conveyor pans 2 also comprise a bottom-run bottom plate 6 which is likewise welded to the side cheek 5 on the filled-up side and to the back of the plough guide trough on the face side, and also comprise toggle bolt-receiving pockets 7 on the filled-up side for insertion of coupling means in the form of a toggle bolts 8 or tension-resistant, bendable coupling means of neighbouring conveyor pans 2. The basic construction of conveyor pans 2 of this type is known to the skilled man and therefore is not discussed here in detail.

As shown in FIG. 1, the plough guide 1 can comprise two different plough guide troughs, that is plough guide troughs 10 with an inspection opening 11 closed by a lid 40 and plough guide troughs 10A having a front wall 12 facing the coal face or working face and without an inspection opening. For financial reasons, usually only each second or third plough guide trough belonging to a plough guide 1 has an inspection opening. Since the plough guide troughs 10, 10A differ substantially only with regard to the presence of the inspection opening 11, the following description of the plough guide troughs in accordance with the present invention will relate to a said plough guide trough 10 with an inspection opening 11. A plough guide trough 10 of this construction is shown by itself in FIGS. 2 to 5, which will now be referred to in subsequent description of the present invention.

The plough guide troughs 10 in accordance with the invention have a cast one-piece base member provided during the initial forming process with a bottom chain duct 13, a top chain duct 14, a back wall 15, a slideway 16, a top guide strip 17, a bottom guide beam 18, the front wall 12 curving between the guide strip 17 and guide beam 18, a sliding spacer member 49 reinforcing the front wall 12 and the back wall 15, and pockets or recesses 19, 20 formed at each end inside the front wall 12. During the original shaping process, the inspection opening 11 is also integrally moulded on the plough guide troughs 10, together with a recess 21 shown in FIGS. 4 and 5 in the sliding spacer member 49 which forms the bottom of the top chain duct 14 and joins the front wall 12 to the back wall 15 on both sides of the recess 21. The recess 21 inside the sliding spacer member 49 and the inspection opening 11 in the front wall 12 are absent from a plough guide trough (10A, FIG. 1) without an inspection opening.

Figure 2:
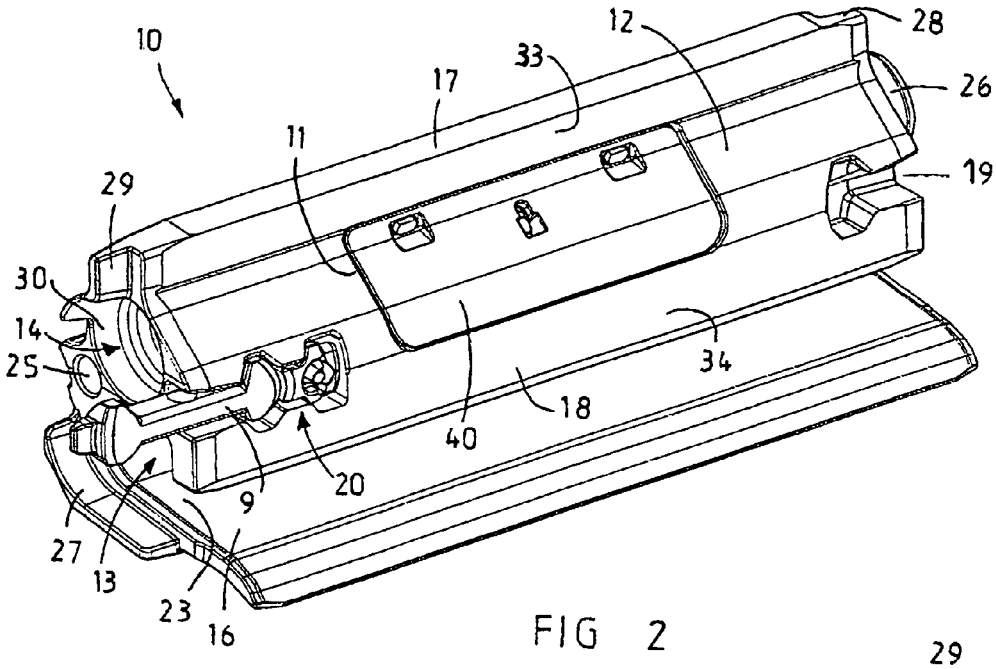
FIG. 2 shows a perspective view of a plough guide trough with an inspection opening.
Figure 3:
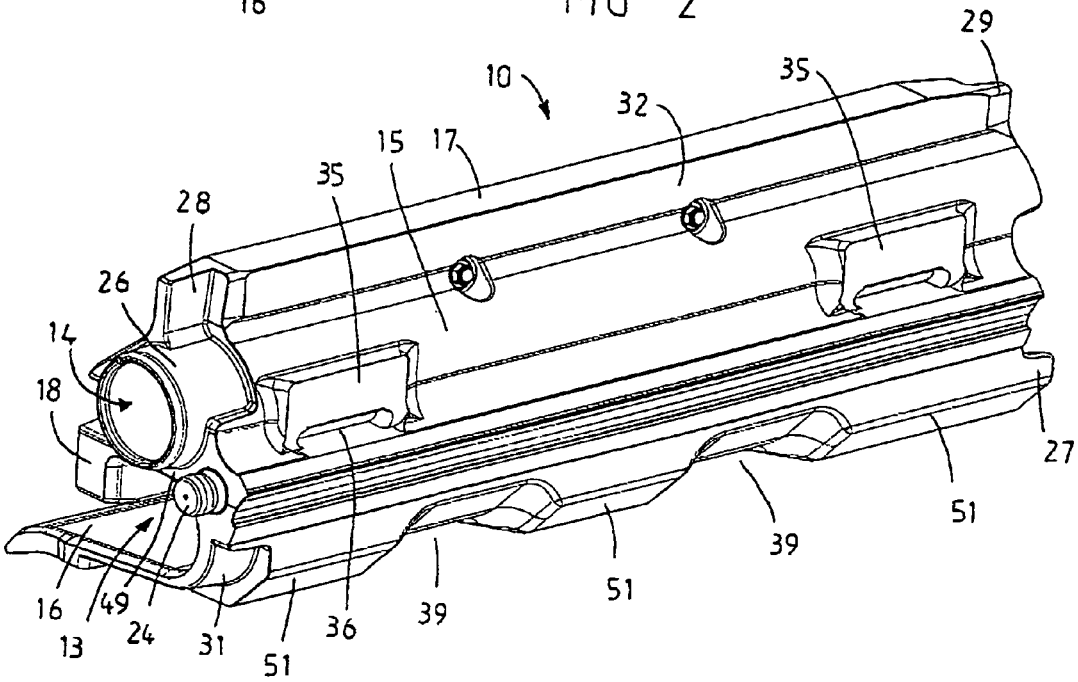
FIG. 3 shows a perspective back view of the plough guide trough shown in FIG. 3.

As shown especially clearly in FIGS. 2 and 3, the front wall 12 and the back wall 15 converge in the guide strip 17 disposed centrally above the top chain guide duct 14, whereas the guide beam 18 at the bottom end of the front wall 12 is offset from the guide strip 17 on the working-face side and extends in front of and underneath the top chain guide duct 14. The guide beam 18 also forms the boundary wall on the working-face side of the bottom chain guide duct 13, except that a slot lead-through 23 is formed between the slideway 16 and the under-surface 22 of the guide beam 18 and a plough knife or plough guiding hook can be inserted through it for engagement in the bottom chain duct 13 and can be connected there to the bottom run of the plough guide chain (not shown).

As also shown in FIGS. 2 and 3, neighbouring plough guide troughs 10 are centred on one another via centring pegs 24 and centring peg receivers 25 and engage in the top chain guide duct 14, at the slideway 16 and in the neighbourhood of the top guide strip 17 via sockets 26 and projections 27 which engage in associated depressions 30, 31 and overlap web portions 28, 29 on the top guide strip 17, wherein the web portions 28 and 29, the sockets 26, the projections 27 and the depressions and recesses 30, 31 are also formed during the initial shaping of the casting. On the guide strip 17, the two parallel lateral boundary surfaces 32, 33 form guide surfaces for a guide shoe on the plough body (not shown) and the guide surfaces 32, 33 can be reworked. The outer boundary surface 34 of the guide beam can also be reworked in order to improve the guidance of the plough body on the guide means.

The toggle-receiving pockets 19, 20 integrally cast directly on the ends of the front wall 12 are constructed differently since one of the two toggle pockets, toggle pocket 20 in this case, receives the toggle head of a connecting toggle 9 and also a toggle securing means which prevents the toggle falling out of the toggle pockets 19 and 20.

Figure 4:
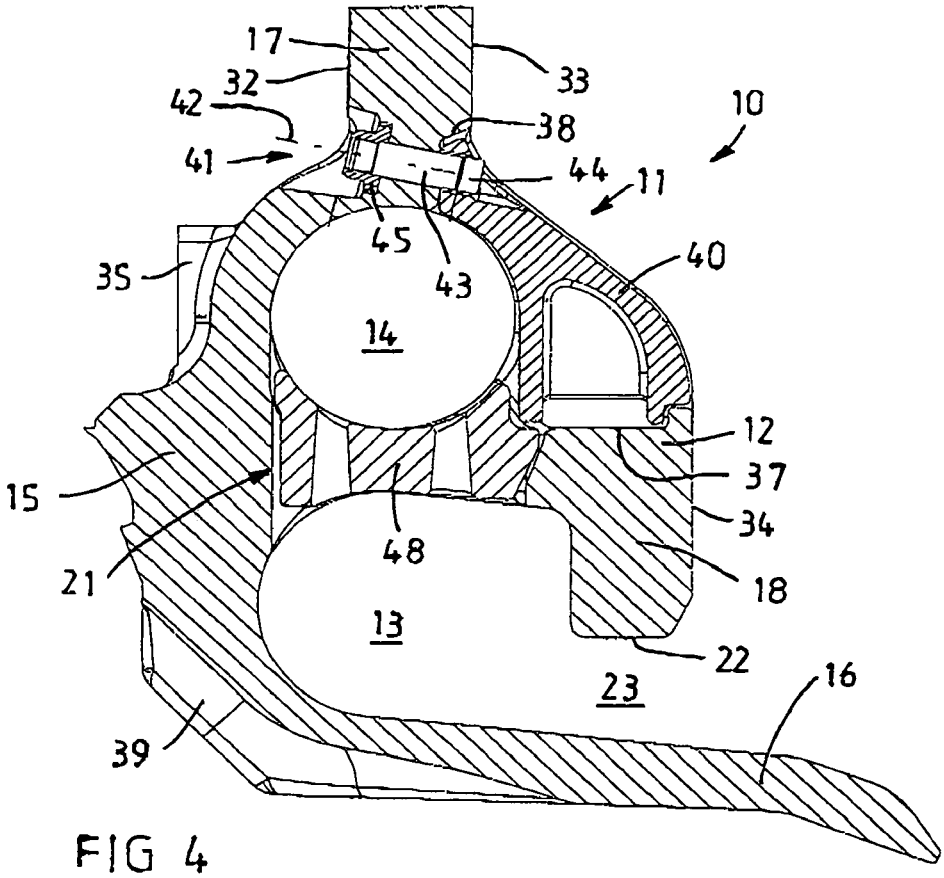
FIG. 4 shows a first vertical section through the plough guide trough shown in FIG. 2.
Figure 5:
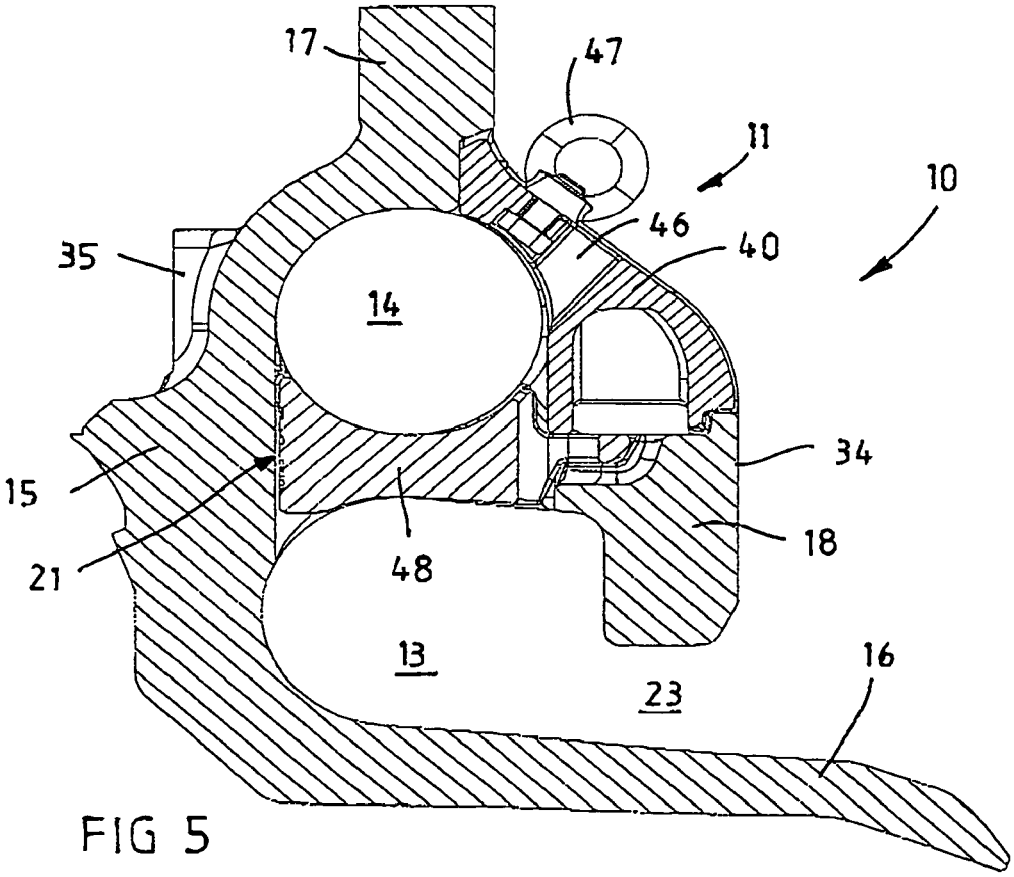
FIG. 5 shows a second vertical section through the plough guide trough shown in FIG. 2.

As shown in FIGS. 3 to 5, two locking pockets 35 are integrally formed, especially by casting, on the back wall 15 and have receiving slots 36 for engagement of lugs or tongues formed on an interchangeable trough, in order directly, in co-operation with the plough guide trough 10 and the locking pockets 35, to form a vertical locking means for the interchangeable trough on the plough guide side of the conveyor pans.

The inspection opening 11 in the side wall 12 is closed by a lid 40 which positively bears on the bottom edge 37 of the inspection opening 11 whereas the top edge 38 of the inspection opening 11 is releasably anchored by two spaced-apart screw fastenings 41. The screw fastening 41 is formed with bores with a sloping axis 42, the bores being formed on the transition region of the guide strip 17 to the walls 15 and 12 which bound the top chain guide duct 14. The screw fastenings 41 comprise T-shaped screw bolts 43 which together with the cross-members lie in depressions in the lid 40, whereas threaded nuts 45 are screwed from the other side on to a threaded portion of the screw bolts 43.

The lid 40, whose contour exactly matches the contour of the side wall 12, has a central keyhole-shaped opening 46 which on the one hand forms an inspection opening and on the other hand can be used for receiving a load lug 47 which can be anchored in the opening 46 by a screw connection so that the lid can be raised by a lifting unit. When the lid 40 is removed, thus uncovering the inspection opening 11, repairs can be carried out on the top run of the plough chain, and after removing a grating 48 inserted into the corresponding recess 21 in the sliding spacer member and replacing the bottom of the top chain duct 14 in the assembled state, repairs can also be carried out on the bottom chain guide duct 13, or the plough chain can be detached from the knife or guide block.

As also shown in FIGS. 4 and 5, both the guide strip 17 and the guide beam 18 are substantially rectangular. As also clearly shown in FIGS. 3 and 4, the underside of the slideway

16 is formed here with two weight-reducing recesses 39, so that the plough guide trough 10 rests only on the remaining supporting ribs 51 on the floor or the like. The weight-reducing recesses 39 are also formed when the plough guide troughs 10 are initially shaped.

The invention claimed is:

1. A plough guide trough for plough guides of chain-drawn coal ploughs, comprising two superposed chain guide ducts separated by an integrally cast sliding spacer member, with a top guide strip, a bottom guide beam and a bottom slideway for guiding the plough, wherein the top chain guide duct is covered by a front wall comprising the guide strip and merging into the guide beam and slot lead-through for a plough guiding hook or plough knife is formed between the guide beam and the slideway, also comprising pockets in the front wall for receiving toggle coupling means for neighboring plough guide troughs, wherein the front wall, the guide strip, the guide beam , the pockets and a back wall comprising the slideway form a one-piece casting extending over the length of the plough guide trough, wherein the back wall on its outside is provided with at least one integrally cast locking pocket for engagement of locking lugs or locking tongues on an interchangeable top trough of a conveyor pan trough.

2. A plough guide trough according to claim 1, in which at least one of the guide strip and the guide beam are provided with reworked guide surfaces.

3. A plough guide trough according to claim 1, in which at least one of the guide strip and the guide beam have substantially vertical guide surfaces.

4. A plough guide trough according to claim 1, in which the underside of the slideway is formed with weight-reducing recesses, wherein a supporting rib is formed on both sides of each recess.

5. A plough guide trough according to claim 1, in which the front wall has an integrally cast inspection opening which is closable by a lid.

6. A plough guide trough according to claim 5, in which near the inspection opening the sliding spacer member has an integrally molded recess for inserting an interchangeable grating.

7. A plough guide trough according to claim 5, in which bores for fastening a closure lid are formed on the transition from the guide strip to the top chain guide duct, wherein the axes of the bores slope down from the back of the guide strip to the top boundary edge of the inspection opening.

8. A plough guide trough according to claim 5, in which the lid has a sight opening.

9. A plough guide trough according to claim 8, in which the sight opening has a contour adapted to receive a load hook.

* * * * *

UNITED STATES PATENT AND TRADEMARK OFFICE

CERTIFICATE OF CORRECTION

PATENT NO. : 7,641,286 B2
APPLICATION NO. : 11/375865
DATED : January 5, 2010
INVENTOR(S) : Siepenkort et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 39 days.

Signed and Sealed this

Sixteenth Day of November, 2010

David J. Kappos

David J. Kappos
*Director of the United States Patent and Trademark Office*